US006044506A

United States Patent [19]

Valene

[11] Patent Number: 6,044,506

[45] Date of Patent: Apr. 4, 2000

[54] WATER/FOAM WHEELCHAIR PAD

[76] Inventor: Murray S. Valene, 7300 Lake Shore Dr., #32, New Orleans, La. 70124

[21] Appl. No.: 08/456,526

[22] Filed: Jun. 1, 1995

[51] Int. Cl.[7] ..... A47C 27/00

[52] U.S. Cl. ..... 5/654; 5/653; 5/655.5

[58] Field of Search ..... 5/450, 451, 654, 5/644, 645, 655.3, 682, 684, 685, 901, 740, 731, 736, 653, 655.5, 737, 738

[56] References Cited

U.S. PATENT DOCUMENTS

| | | | |
|---|---|---|---|
| 819,903 | 5/1906 | Maussner | 5/738 X |
| 2,822,554 | 2/1958 | Wenzelberger | 5/450 |
| 3,574,873 | 4/1971 | Weinstein | 5/655.5 |
| 3,600,726 | 8/1971 | Williams | 5/655.5 X |
| 3,663,973 | 5/1972 | Spence | 5/655.5 |
| 4,143,435 | 3/1979 | Masuda | 5/736 X |
| 4,207,636 | 6/1980 | Ceriani | 5/740 X |
| 4,276,666 | 7/1981 | Yamada | 5/740 X |
| 4,445,240 | 5/1984 | Voorhees | 5/655.5 |
| 4,459,714 | 7/1984 | Lin | 5/655.5 X |
| 4,462,128 | 7/1984 | LaBianco | 5/451 |
| 4,673,216 | 6/1987 | Alfer | 5/654 |
| 4,673,452 | 6/1987 | Awdhan | 5/901 X |
| 4,706,313 | 11/1987 | Murphy | 5/737 X |
| 4,726,087 | 2/1988 | Schaefer et al. | 5/901 X |
| 4,780,921 | 11/1988 | Lahn et al. | 5/630 |
| 4,899,405 | 2/1990 | Rothbard | 5/901 X |
| 4,975,996 | 12/1990 | Evans et al. | 5/740 X |
| 5,022,111 | 6/1991 | Fenner, Sr. | 5/740 X |
| 5,059,316 | 10/1991 | Renton | 210/198.1 |
| 5,077,848 | 1/1992 | McDaniel et al. | 5/451 |
| 5,163,194 | 11/1992 | Dixon | 5/901 X |
| 5,421,043 | 6/1995 | McDaniel et al. | 5/684 |
| 5,636,397 | 6/1997 | Boyd et al. | 5/740 X |
| 5,639,145 | 6/1997 | Alderman | 5/653 X |
| 5,787,527 | 8/1998 | Anderson | 5/484 |

FOREIGN PATENT DOCUMENTS

| | | | |
|---|---|---|---|
| 3633867 | 4/1988 | Germany | 5/654 |
| 984604 | 2/1965 | United Kingdom | 5/737 |
| 2238716 | 6/1991 | United Kingdom | 5/654 |

*Primary Examiner*—Brian K. Green
*Assistant Examiner*—Robert G. Santos
*Attorney, Agent, or Firm*—Hugh D. Jaeger

[57] ABSTRACT

Wheelchair pad for providing support to a person in a wheelchair including support by a waterbed-like bladder containing a convoluted foam body and water.

1 Claim, 2 Drawing Sheets

WATER/FOAM WHEELCHAIR PAD

CROSS REFERENCES TO CO-PENDING APPLICATIONS

None.

BACKGROUND OF THE INVENTION

1. Field of the Invention

The present invention is for health care devices, and more particularly pertains to a water/foam wheelchair pad for supporting a person in a wheelchair.

2. Description of the Prior Art

Prior wheelchair pads consist of flexible enclosures in which fill support material such as foam, beaded foam, wire strings and other like material, is contained. Some of these fill materials, while initially offering comfortable support to the posterior of a wheelchair user, eventually assume a packed down state where the fill material packs down or migrates to the side of the areas which formerly offered gentle support. When this occurs, little comfort and aid to a person using the wheelchair is offered. Determining the correct amount of fill material for the pad according to the size and weight of the person also persists as a problem. If the person soiled the wheelchair pad, the interior would soak up waste effluent, thus contaminating the fill material, at which point the fill material would have to be cleaned or discarded and the entire covering washed or laundered, if not thrown out.

Clearly, what is needed is a wheelchair pad which is convenient for all users, which has a stable non-migrating fill material which is non-contaminatable, and which offers proper and even support over the entire support surface.

SUMMARY OF THE INVENTION

The general purpose of the present invention is to provide a water/foam wheelchair pad.

According to the disclosed embodiment of the present invention, there is provided a water/foam wheelchair pad, including a heavy vinyl waterbed-like bladder comprising walls defining a hollow chamber containing a convoluted foam support body. Water is introduced to the interior of the bladder containing the convoluted foam support body through a filler valve assembly having a flapper valve. A washable and removable fleece cover overlies the bladder for additional comfort. Support for the user is twofold: support is offered by the convoluted foam body and support is offered by the water captured inside the bladder.

One significant aspect and feature of the present invention is a wheelchair pad having both water and foam support.

Another significant aspect and feature of the present invention is the use of convoluted foam for progressive support in combination with the hydraulic properties of water.

Still another significant aspect and feature of the present invention is a non-contaminatable vinyl bladder separate from a fleece or other such soft outer washable cover.

Yet another significant aspect and feature of the present invention is a fleece cover to provide a breathing space between the user and the vinyl bladder.

An additional significant aspect and feature of the present invention is the use of a water treatment chemical interior to the water/foam wheelchair pad.

Still an additional significant aspect and feature of the present invention is adjustability of firmness of the pad according to the amount of contained support water in the bladder.

A further significant aspect and feature of the present invention is a fill material which is resilient and does not pack or migrate.

Having thus described significant aspects and features of the present invention, it is the principal object of the present invention to provide a water/foam wheelchair pad.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
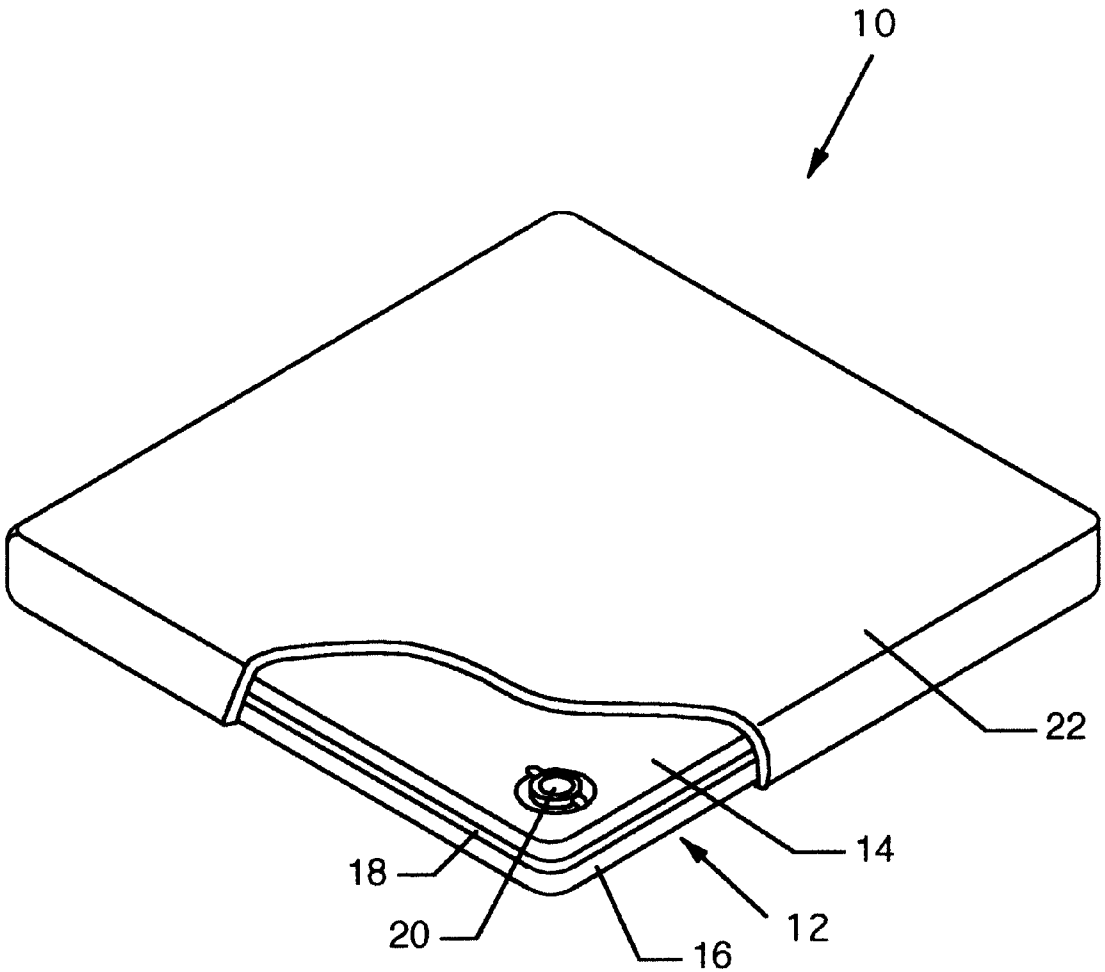
FIG. 1 illustrates an isometric cutaway view of a water/foam wheelchair pad; and, FIG. 2 illustrates a cross sectional view of the water/foam wheelchair pad in the general region of the filler valve assembly.

FIG. 1 illustrates an isometric cutaway view of a water/foam wheelchair pad 10. Visible components of the water/foam wheelchair pad 10 include a heavy flexible vinyl sealed waterbed-like bladder 12 having a top member 14 and a bottom member 16, an electronically, such as radio frequency, or otherwise suitably sealed seam 18 formed between and adjoining the top and bottom members 14 and 16 to form a watertight hollow chamber, a filler valve assembly 20, and a pocketed removable fleece cover 22 aligned over and about the bladder 12. Two layers of convoluted foam are located interior to the bladder 12, as shown in FIG. 2.

Figure 2:
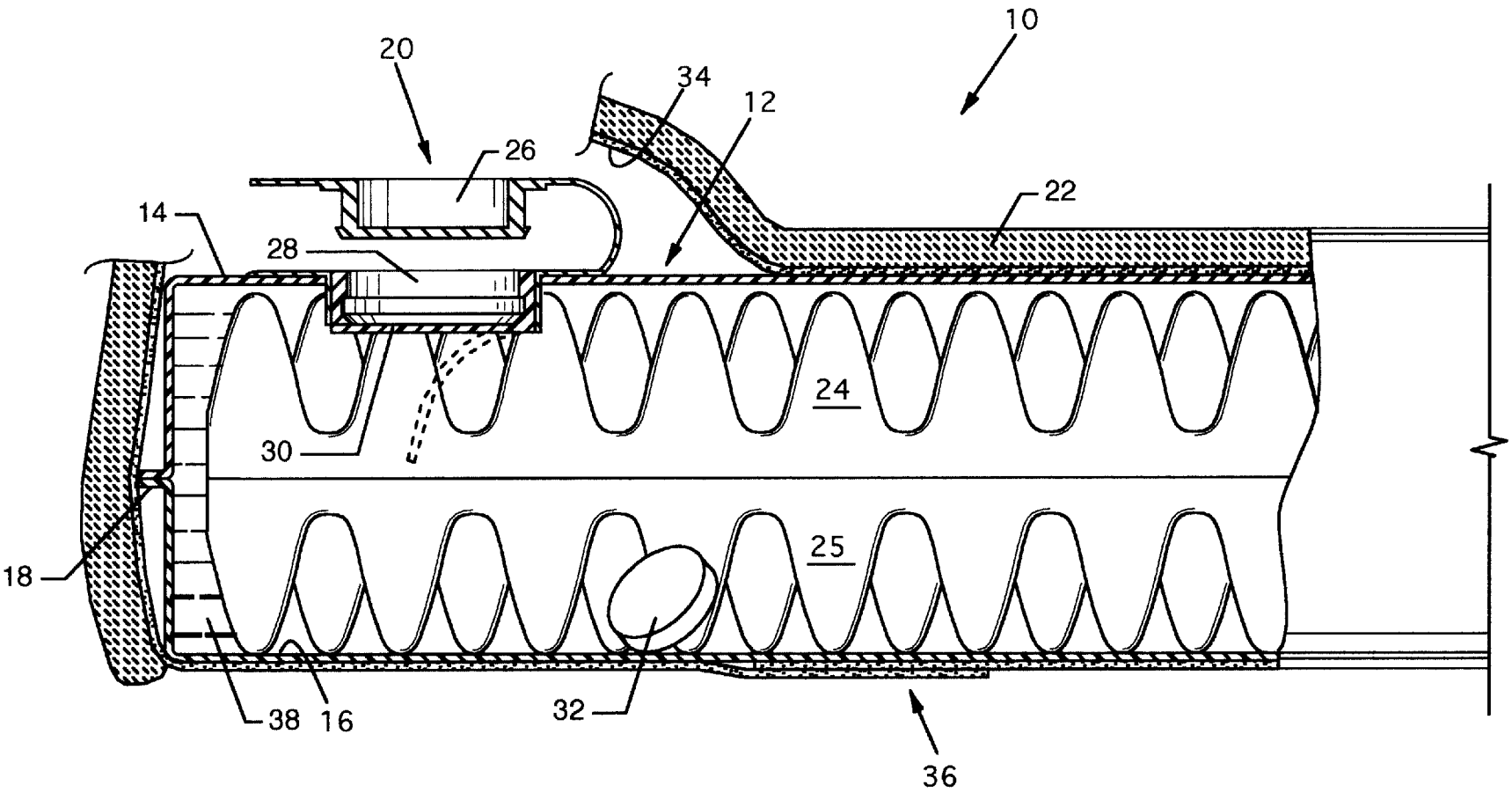

FIG. 2 illustrates a cross sectional view of the water/foam wheelchair pad 10 in the general region of the filler valve assembly 20, where all numerals correspond to those elements previously described. A body of convoluted foam, including convoluted foam layer 24 glued back to back with a reversed convoluted foam layer 25, is located between the top and bottom layers 14 and 16 of the bladder 12 of the water/foam wheelchair pad 10. The filler valve assembly 20 includes a top plug member 26, a bottom receptacle member 28 sealed to the top member 14 of the bladder 12, and a positionable flapper valve 30, which can be temporarily repositioned (as illustrated in dashed lines) for filling the bladder with water 38, attached to the bottom of the bottom receptacle member 28. At least one water treatment pill 32, such as dimethylane ammonium chloride, is included within the bladder 12 to kill bacteria and other such impurities. A cover 22 of fleece or synthetic material or other soft fleece-like material includes a fabric backing 34 forming a pocket which aligns around and about the bladder 12 containing the convoluted foam layers 24 and 25. The fabric backing 34 includes an overlap opening 36 which allows the bladder 12 and included interior convoluted foam layers 24 and 25 to be loaded into the surrounding fleece cover pocket. Maneuvering of the overlap opening 36 allows the filler valve assembly end of the bladder 12 to be accessed for filling or draining.

MODE OF OPERATION

Once the fleece cover 22 has been maneuvered to expose the filler valve assembly 20, it is a simple matter to forcefully insert a filler device through the bottom receptacle member 28 to move the flapper valve 30 to its open position (as illustrated in dashed lines in FIG. 2) for filling with a prescribed amount of water 38 depending on the weight of the person. Water 38 is illustrated only at the extreme left of FIG. 2 for purposes of clarity and brevity. With the filler valve assembly 20, including the flapper valve 30 still in the open position, the person can sit on the bladder 12 to expel any trapped air in the interior of the bladder 12 through the filler valve assembly 20. The filler device is then removed and the flapper valve 30 is then allowed to close against the bottom receptacle member 28. The top plug member 26 is then inserted into the bottom receptacle member 28 to effect a complete seal to contain the water inside the bladder 12. Support is offered to a person in a two-fold manner: support is offered by the convoluted foam layers 24 and 25 providing progressive static and dynamic mechanical support and support is offered hydraulically by the water encapsulated in the enclosed interior of the waterbed-like bladder 12.

Various modifications can be made to the present invention without departing from the apparent scope hereof.

I claim:

1. A water/foam pad in which both water and foam provide support and comfort to a user sitting on the pad, comprising:

a. a bladder composed of a top member and a bottom member which are sealed to one another and which together define a hollow, watertight, enclosed chamber having a top wall, a bottom wall, and side walls, said top member forming at least said top wall of said hollow chamber, and said bottom member forming at least said bottom wall of said hollow chamber;

b. a body of resilient foam positioned within said hollow chamber of said bladder, said body of resilient foam including two layers of resilient foam each having a back surface and a convoluted surface which face in opposite directions, said back surfaces of said two layers being glued together, said convoluted surface of one of said layers contacting said bottom wall of said hollow chamber, said convoluted surface of the other one of said two layers lying closely adjacent to said top wall of said hollow chamber, and said two layers together occupying substantially the entire internal volume of said hollow chamber;

c. a valve assembly located in a wall of said hollow chamber for allowing air and water passage into and out of said hollow chamber; said valve assembly including a flapper valve and a closure plug;

d. a quantity of water contained within said hollow chamber and filling substantially the remainder of the internal volume of said hollow chamber unoccupied by said two layers of resilient foam; and, e. a cover of soft material positioned over said bladder for providing a breathing space between said bladder and a user of said pad, said cover being attached to a fabric backing which completely encloses said bladder and which has overlapped portions defining an opening through which said bladder can be inserted and removed.

* * * * *